US005833143A

United States Patent [19]

Hsin-Fa

[11] Patent Number: 5,833,143

[45] Date of Patent: Nov. 10, 1998

[54] GARDEN HOSE NOZZLE

[76] Inventor: Wang Hsin-Fa, P.O. Box 453, Taichung, Taiwan

[21] Appl. No.: 866,618

[22] Filed: May 30, 1997

[51] Int. Cl.[6] ..... B05B 1/32

[52] U.S. Cl. ..... 239/456; 239/505; 239/520; 239/581.2

[58] Field of Search ..... 239/456, 505, 239/518, 520, 580, 581.1, 581.2

[56] References Cited

U.S. PATENT DOCUMENTS

| | | | |
|---|---|---|---|
| 2,935,265 | 5/1960 | Richter | 239/456 |
| 2,968,440 | 1/1961 | Cone | 239/456 |
| 4,119,275 | 10/1978 | Hunter | 239/456 |
| 5,031,840 | 7/1991 | Grundy et al. | 239/456 |
| 5,152,458 | 10/1992 | Curtis | 239/456 |

*Primary Examiner*—Andres Kashnikow
*Assistant Examiner*—Lisa Ann Douglas

[57] ABSTRACT

A garden hose nozzle is composed of a cylindrical housing, a toothed disk, a shaft member and a fastening bolt. The fastening bolt is used to fasten the tooth disk and the shaft member in the stepped axial hole of the cylindrical housing. The shaft member can be rotated manually such that the interstices of various sizes are formed between a tapered ring edge of the stepped axial hole of the cylindrical housing and the tapered portion of the shaft member for regulating the sprinkling pattern of water.

1 Claim, 4 Drawing Sheets

GARDEN HOSE NOZZLE

FIELD OF THE INVENTION

The present invention relates generally to a gardening implement, and more particularly to a garden hose nozzle.

BACKGROUND OF THE INVENTION

The conventional garden hose nozzles are generally defective in design in that they are rather complicated in construction, and that they can not be therefore made economically.

SUMMARY OF THE INVENTION

It is therefore the primary objective of the present invention to provide an improved garden hose nozzle which is relatively simple in construction.

It is another objective of the present invention to provide an improved garden hose nozzle which is cost-effective.

In keeping with the principle of the present invention, the foregoing objectives of the present invention are attained by a garden hose nozzle, which consists of a cylindrical housing, a toothed disk, a shaft member and a fastening bolt. The funnel-shaped shaft member has a threaded rod extending from the tapered portion of the shaft member. The toothed disk is provided with a plurality of through holes, a threaded center hole, and a plurality of inclined teeth arranged at an interval along the periphery of the toothed disk. The shaft member and the toothed disk are located in the stepped hole of the cylindrical housing such that the thread rod of the shaft member is engaged with the threaded center hole of the toothed disk, and that the shaft member and the toothed disk are held together by the fastening bolt which is engaged with the threaded rod of the shaft member. The gap between the tapered portion of the shaft member and the stepped hole of the cylindrical housing can be adjusted to regulate the sprinkling pattern of water.

The foregoing objectives, features, functions and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
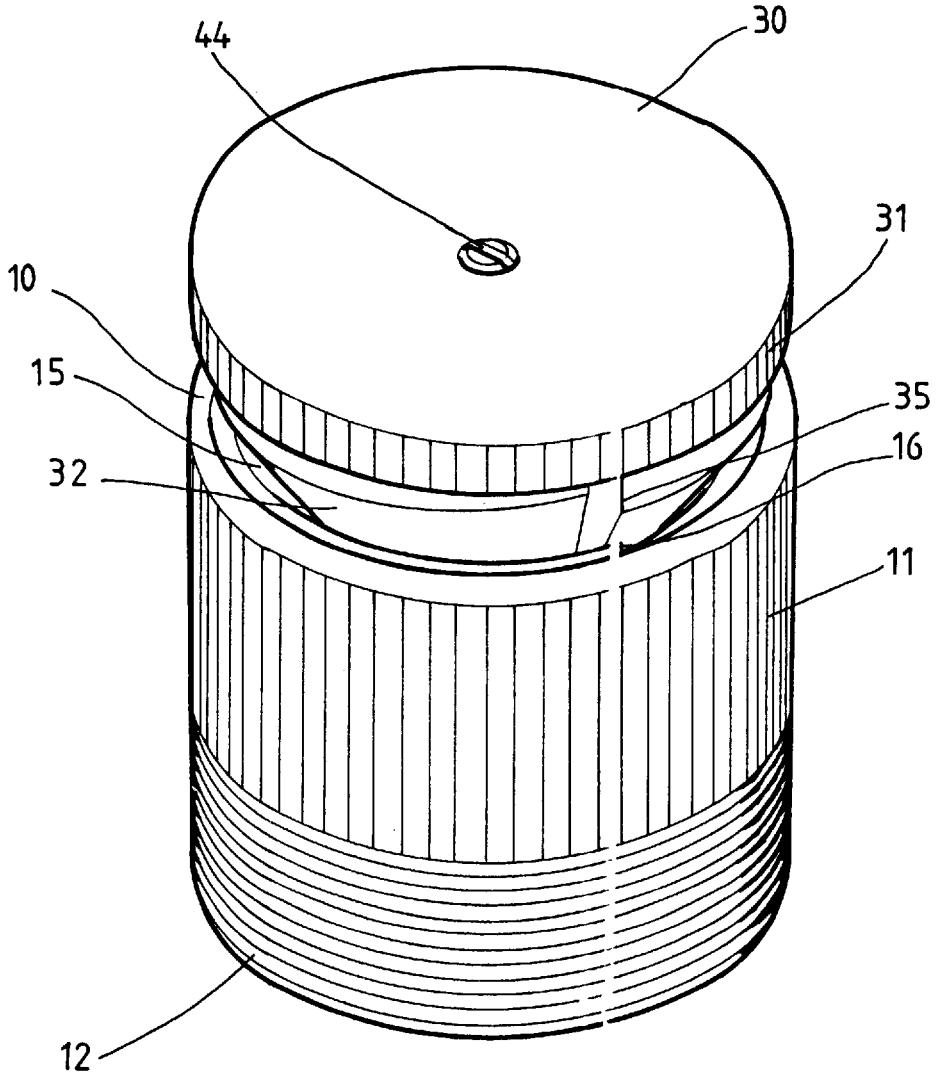
FIG. 1 shows a perspective view of a garden hose nozzle of the present invention.
Figure 2:
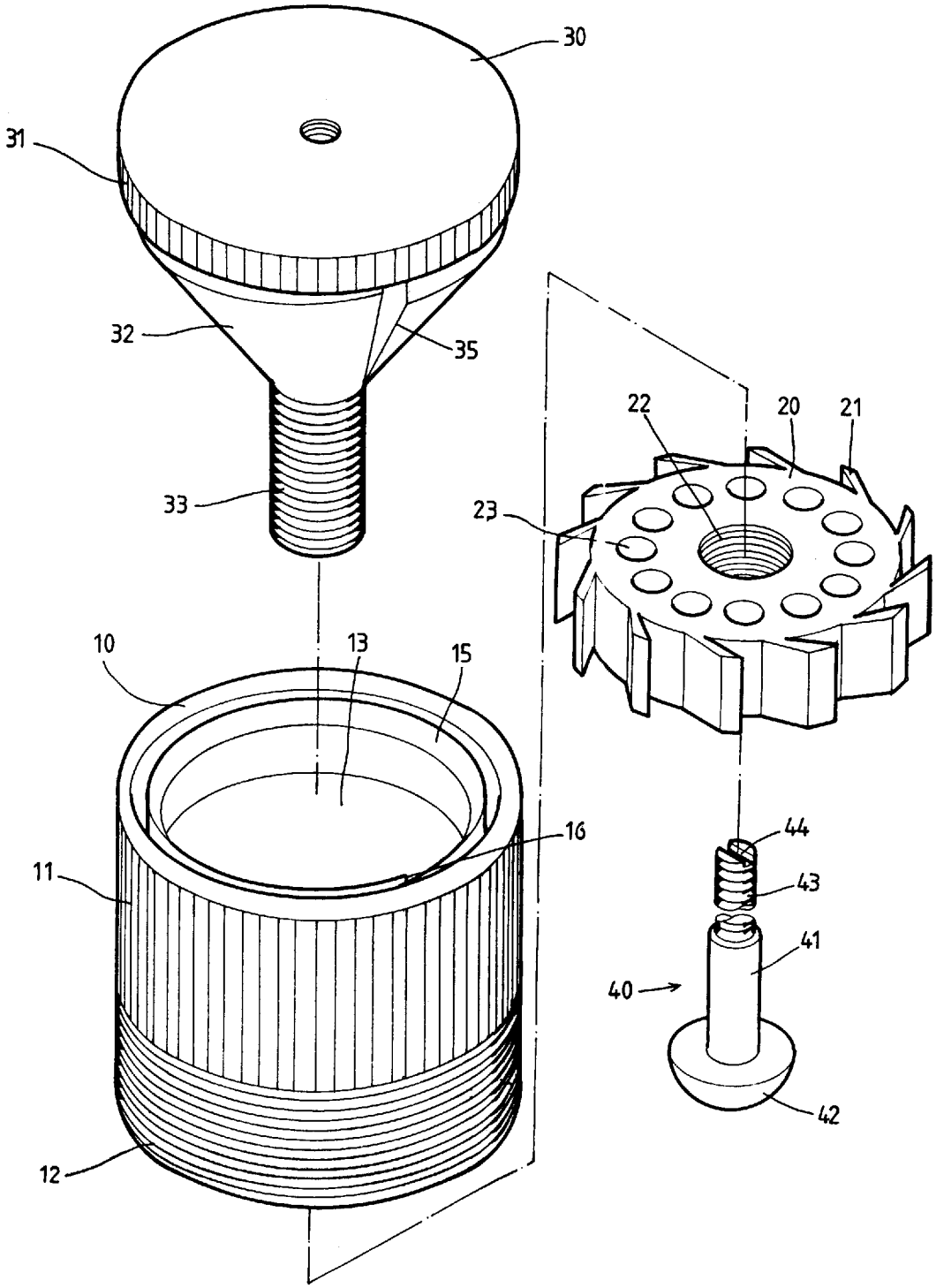
FIG. 2 shows an exploded view of the garden hose nozzle of the present invention.
Figure 3:
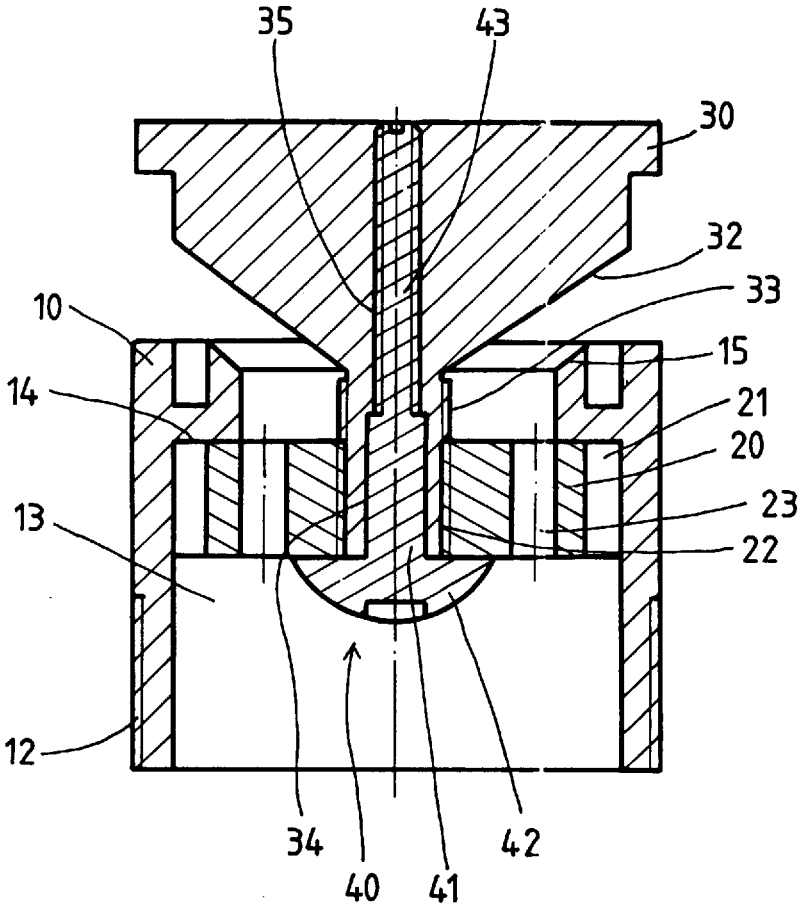
FIG. 3 shows a longitudinal sectional view of the present invention in combination.
Figure 4:
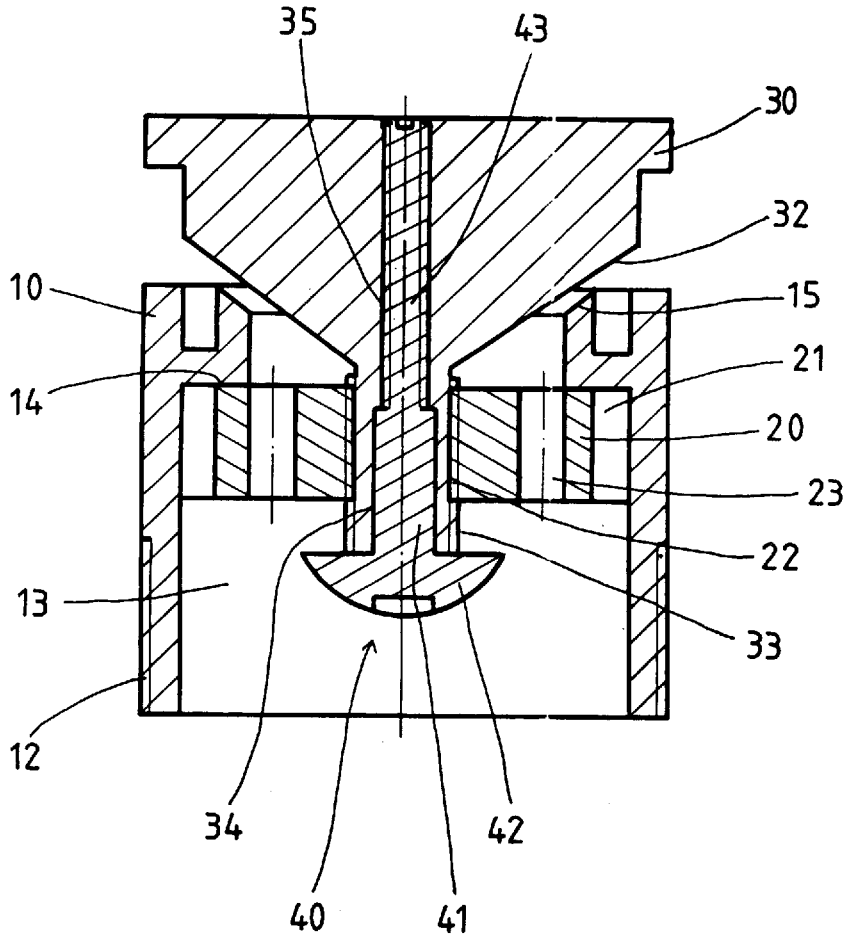
FIG. 4 shows a schematic view of the present invention at work.

As shown in FIGS. 1–3, a garden hose nozzle embodied in the present invention is composed of a cylindrical housing 10, a toothed disk 20, a shaft member 30, and a fastening bolt 40.

The cylindrical housing 10 is provided on the outer wall surface thereof with an anti-skid threaded portion 11 and a connection threaded Portion 12 engageable with the threaded portion of a hose. The cylindrical housing 10 is further provided with a stepped axial hole 13, which is in turn provided in the midsegment thereof with a stopping ring edge 14, and at the top end thereof with a tapered ring edge 15.

The toothed disk 20 is provided circumferentially with a plurality of inclined teeth 21 and is further provided with a threaded center hole 22, and a plurality of through holes 23 circling the threaded center hole 22.

The shaft member 30 is of a funnel-shaped construction and is composed of a disklike top portion and a tapered portion 32. The disklike top portion is provided circumferentially with an anti-skid threaded portion 31. The tapered portion 32 has a threaded rod 33 extending therefrom. The threaded rod 33 is provided therein with an inner fitting hole 34 and an inner threaded hole 35 extending coaxially from the inner fitting hole 34 along the direction of the longitudinal axis of the threaded rod 33.

The fastening bolt 40 has a head 42, a shank 41 extending from the head 42, and a threaded Portion 43 extending from the shank 41. The threaded Portion 43 is provided at the free end thereof with an adjustment slot 44. The head 42 is greater in diameter than shank 41 and the threaded Portion 43.

The toothed disk 20 and the shaft member 30 are housed in the hollow interior of the cylindrical housing 10 such that the toothed disk 20 is located under the stopping ring edge 14 of the cylindrical housing 10, and that the shaft member 30 is located over the stopping ring edge 14 of the cylindrical housing 10, and further that the threaded rod 33 of the shaft member 30 is engaged with the threaded center hole 22 of the toothed disk 20, and still further that the toothed disk 20 and the shaft member 30 are held together in the cylindrical housing 10 by the fastening bolt 40 which is engaged with the inner threaded hole 35 of the threaded rod 33 of the shaft member 30 in such a manner that the head 42 of the fastening bolt 40 is stopped by the underside of the toothed disk 20, and that the shank 41 of the fastening bolt 40 is fitted into the fitting hole 34 of the threaded rod 33.

The through holes 23 of the toothed disk 20 serve as passageways of water entering the cylindrical housing 10 from a hose which is fastened with the connection threaded portion 12 of the cylindrical housing 10. Upon having passed the through holes 23 of the toothed disk 20, the water is sprinkled through the interstice located between the tapered ring edge 15 of the stepped axial hole 13 of the cylindrical housing 10 and the tapered portion 32 of the shaft member 30. The size of the interstice can be adjusted by rotating the shaft member 30 with one hand holding the anti-skid threaded portion 31 of the shaft member 30, and with another hand holding the anti-skid threaded portion 11 of the cylindrical housing 10. As the shaft member 30 is rotated, the toothed disk 20 is actuated to turn accordingly. As a result, the shaft member 30 can be located securely at a desired position by means of the inclined teeth 21 of the toothed disk 20, which are capable of urging the wall of the stepped axial hole 13 of the cylindricial housing 10.

In view of the toothed disk 20 which is located under the stopping ring edge 14 of the stepped axial hole 13 of the cylindrical housing 10, the shaft member 30 can be therefore rotated upwards in a limited range, thereby limiting the size of the interstice located between the tapered ring edge 15 of the stepped axial hole 13 and the tapered portion 32 of the shaft member 30. In addition, the toothed disk 20 is located in such a manner as described above, the shaft member 30 is prevented from becoming disengaged while it is being rotated.

Moreover, the tapered ring edge 15 of the stepped axial hole 13 of the cylindrical housing 10 is provided with a lower stepped edge 16, while the tapered portion 32 of the shaft member 30 is provided with an upper stepped edge 35. When the shaft member 30 is rotated downwards, the upper stepped edge 35 of the shaft member 30 makes contact with the lower stepped edge 16 of the tapered ring edge 15 of the cylindrical housing 10 so as to prevent the interstice from being eliminated. If the interstice located between the tapered ring edge 15 and the tapered portion 32 is accidentally eliminated by the downward motion of the shaft member 30, the sprinkling failure is inevitable.

What is claimed is:

1. A hose nozzle comprising:

a cylindrical housing provided on an outer wall thereof with an anti-skid threaded portion and a connection threaded portion engageable with the threaded portion of a hose, said cylindrical housing further provided therein with a stepped axial hole which is in turn provided in a midsegment thereof with a stopping ring edge and at a top end thereof with a tapered ring edge having a lower stepped edge;

a toothed disk provided circumferentially with a plurality of inclined teeth and further provided with a threaded center hole and a plurality of through holes serving as passageways for water entering said cylindrical housing from the hose with which said cylindrical housing is connected;

a shaft member of a funnel-shaped construction and having a disklike top portion and a tapered portion extending from said disklike top portion, said disklike top portion provided circumferentially with an anti-skid threaded portion, said tapered portion provided with a threaded rod extending therefrom and having an inner fitting hole and an inner threaded hole extending coaxially from said inner fitting hole along the direction of a longitudinal axis of said threaded rod; and a fastening bolt having a head, a shank extending from said head and smaller in diameter than said head, and a threaded portion extending from said shank and smaller in diameter than said head, said threaded portion provided at a free end thereof with an adjustment slot;

said toothed disk and said shaft member being housed in said cylindrical housing such that said toothed disk is located under said stopping ring edge of said stepped axial hole of said cylindrical housing, and that said shaft member is located over said stopping ring edge of said stepped axial hole of said cylindrical housing, and further that said threaded rod of said shaft member is engaged with said threaded center hole of said toothed disk, and still further that said toothed disk and said shaft member are held together in said cylindrical housing by said fastening bolt which is engaged with said inner threaded hole of said threaded rod of said shaft member in such a manner that said head of said fastening bolt is stopped by the underside of said toothed disk, and that said shank of said fastening bolt is fitted into said inner fitting hole of said threaded rod of said shaft member;

said tapered ring edge of said stepped axial hole of said cylindrical housing and said tapered portion of said shaft member forming therebetween an interstice which can be adjusted in size by rotating said shaft member and is intended for sprinkling water flowing through said through holes of said toothed disk;

said tapered portion of said shaft member provided with an upper stepped edge capable of making contact with said lower stepped edge of said tapered ring edge of said cylindrical housing at such time when said shaft member is rotated in direction towards said toothed disk, thereby preventing said interstice from being eliminated by an excessive rotation of said shaft member.

* * * * *